US009396863B2

(12) United States Patent
Eom et al.

(10) Patent No.: US 9,396,863 B2
(45) Date of Patent: Jul. 19, 2016

(54) TRANSFORMER

(71) Applicant: Solum Co., LTD., Suwon-si (KR)

(72) Inventors: Jae Gen Eom, Hwaseong (KR); Myeong Sik Cheon, Suwon (KR); Deuk Hoon Kim, Incheon (KR); Sang Joon Seo, Suwon (KR); Geun Young Park, Suwon (KR)

(73) Assignee: SOLUM CO., LTD., Suwon (KR)

( * ) Notice: Subject to any disclaimer, the term of this patent is extended or adjusted under 35 U.S.C. 154(b) by 0 days.

(21) Appl. No.: 14/154,862

(22) Filed: Jan. 14, 2014

(65) Prior Publication Data

US 2014/0125443 A1 May 8, 2014

Related U.S. Application Data

(63) Continuation of application No. 13/324,120, filed on Dec. 13, 2011, now Pat. No. 8,643,459.

(30) Foreign Application Priority Data

Dec. 20, 2010 (KR) ..... 10-2010-0130719

(51) Int. Cl.

| | |
|---|---|
| ***H01F 27/30*** | (2006.01) |
| ***H01F 27/02*** | (2006.01) |
| ***H01F 27/28*** | (2006.01) |
| ***H01F 27/29*** | (2006.01) |
| ***H01F 17/04*** | (2006.01) |
| ***H01F 27/26*** | (2006.01) |
| ***H01F 27/32*** | (2006.01) |

(52) U.S. Cl.

CPC ..... *H01F 27/26* (2013.01); *H01F 27/29* (2013.01); *H01F 27/30* (2013.01); *H01F 27/325* (2013.01)

(58) Field of Classification Search

CPC ... H01F 27/292; H01F 38/12; H01F 27/2823; H01F 27/325; H01F 27/2847

USPC ..... 336/83, 90, 180, 192, 198, 221

See application file for complete search history.

(56) References Cited

U.S. PATENT DOCUMENTS 3,824,519 A * 7/1974 Miller ..... 336/192
4,000,483 A * 12/1976 Cook et al. ..... 336/98

(Continued)

FOREIGN PATENT DOCUMENTS

CN 2610436 Y 4/2004
CN 201319302 Y 9/2009

(Continued)

OTHER PUBLICATIONS

Chinese Office Action mailed Feb. 26, 2014 in corresponding Chinese Application No. 201110412218.4.

(Continued)

*Primary Examiner* — Tsz Chan

(57) ABSTRACT

A transformer, according to one possible embodiment, includes: a bobbin part formed by stacking a plurality of bobbins including external connection terminals; and coils respectively wound around the plurality of bobbins. At least one bobbin of the plurality of bobbins includes withdrawing grooves formed in a space between the external connection terminals, the respective coil wound around the at least one bobbin being withdrawn outside the bobbin via the withdrawing grooves and coupled to the external connection terminal.

11 Claims, 6 Drawing Sheets

(56) References Cited

U.S. PATENT DOCUMENTS

| | | | | |
|---|---|---|---|---|
| 4,716,394 | A * | 12/1987 | Gordon | 336/192 |
| 5,534,839 | A | 7/1996 | Mackin et al. | 336/192 |
| 5,673,013 | A * | 9/1997 | Moody et al. | 336/192 |
| 6,630,880 | B2 | 10/2003 | Cheung et al. | 336/198 |
| 7,446,637 | B1 * | 11/2008 | Liang et al. | 336/65 |
| 2003/0098769 | A1 * | 5/2003 | Cheung et al. | 336/208 |
| 2005/0275498 | A1 * | 12/2005 | Haga | 336/208 |
| 2007/0052513 | A1 | 3/2007 | Chang | 336/212 |
| 2010/0013590 | A1 * | 1/2010 | Chen et al. | 336/84 R |
| 2010/0102914 | A1 | 4/2010 | Ger et al. | |

FOREIGN PATENT DOCUMENTS

| | | | |
|---|---|---|---|
| EP | 774824 | A1 * | 5/1997 |
| GB | 2112746 | A | 7/1983 |
| JP | 58-147011 | | 9/1983 |
| JP | 5-48318 | | 6/1993 |
| JP | 2005-033134 | | 2/2005 |
| JP | 2005033134 | A | 2/2005 |
| JP | 2005033134 | A * | 2/2005 |
| JP | 2009-252787 | | 10/2009 |
| KR | 10-0717727 | | 5/2007 |

OTHER PUBLICATIONS

Korean Office Action dated Mar. 23, 2012 issued in related Korean Patent Application No. 10-2011-0138144.

Korean Office Action dated Mar. 23, 2012 issued in related Korean Patent Application No. 10-2012-0008335.

U.S. Appl. No. 13/324,120, filed Dec. 13, 2011, Jae Gen Eom et al., Samsung Electro-Mechanics Co., Ltd.

* cited by examiner

TRANSFORMER

CROSS-REFERENCE TO RELATED APPLICATIONS

This application is a U.S. continuation application filed under 37 CFR 1.53(b) claiming priority benefit of U.S. Ser. No. 13/324,120 filed in the United States on Dec. 13, 2011, which claims earlier foreign priority benefit to Korean Patent Application No. 10-2010-0130719 filed with the Korean Intellectual Property Office on Dec. 20, 2010, the disclosures of which are incorporated herein by reference.

BACKGROUND

1. Field

The present invention relates to a transformer and a flat panel display device including the same, and more particularly, to a thin transformer employed in an LED display device or a thin display device such as an LED display device, and a flat panel display including the same.

2. Description of the Related Art

In general, driving power is necessary in order to drive an electronic device, and a power supply device is necessarily employed in order to supply this driving power to an electronic device.

This power supply device includes a transformer for transforming a commercial power or other input power into a desired power (e.g., a direct current power).

Transformers according to the related art have a form in which a primary coil and a secondary coil are wound around a single bobbin in order and a core is combined with the bobbin through a penetration hole in the bobbin.

In transformers according to the related art, the primary coil has been wound around a winding region of the bobbin, followed by the winding of the secondary coil. This structure has caused prior transformers to have a very small leakage inductance.

Accordingly, a separate inductor is required in a case where more leakage inductance is required, and this may lead to an increase in the volume of the electronic device.

SUMMARY

According to an aspect of the present invention, there is provided a transformer, including: a bobbin part formed by stacking a plurality of bobbins including external connection terminals; and coils respectively wound around the plurality of bobbins, wherein at least one of the plurality of bobbins includes withdrawing grooves formed in a space between the external connection terminals, the coils wound around the bobbin being withdrawn outside the bobbin via the withdrawing grooves and coupled to the external connection terminal.

The bobbin part may include a tube-shaped body part having a penetration hole therein; flange parts protruded outwardly from both sides of the body part; and a terminal coupling part protruded from one side of any one of the flange parts, and having external connection terminals coupled therewith.

The bobbin part may include a first bobbin and a second bobbin stacked and combined with each other, the first bobbin and the second bobbin being combined with each other such that that terminal coupling part of the first bobbin and the terminal coupling part of the second bobbin are arranged in opposite directions.

At least one of the plurality of bobbins may include a plurality of guiding protrusions formed on the terminal coupling part, the coils being coupled to the external connection terminals via the space between the guiding protrusions.

The withdrawing grooves may be formed between the guiding protrusions.

The transformer may further include a bobbin fixing member combined with the bobbin part to fix and combine at least two of the bobbins.

The bobbin fixing member may include at least one supporting member protruded outwardly.

The bobbin fixing member may further include at least one supporting member being safely seated on a substrate so as to support the transformer when the transformer is being mounted on the substrate.

According to another aspect of the present invention, there is provided a transformer, including: a bobbin part formed by stacking a plurality of bobbins including terminal coupling parts having external terminals coupled therewith; and coils respectively wound around the plurality of bobbins, wherein at least one of the plurality of bobbins includes a plurality of guiding protrusions formed on the terminal coupling part, the coils wound around at least one of the bobbins supporting the guiding protrusions and being coupled to the external connection terminals.

According to another aspect of the present invention, there is provided a transformer, including: a bobbin part formed by stacking a plurality of bobbins; and at least one bobbin fixing member combined with at least two sequentially stacked bobbins to fix and combine at least two bobbins, wherein the bobbin fixing member includes at least one supporting member being safely seated on a substrate to support the transformer when the transformer is being mounted on the substrate.

The supporting member may be protruded from the bobbin fixing member.

At least one bobbin fixing member may include a plate-shaped fixing body; and at least two intersection plates protruded from one surface of the fixing body to support the upper surface of the upper bobbin and the lower surface of the lower bobbin.

The bobbin fixing member may further include a middle insertion plate formed in the middle of the fixing body so that the middle insertion plate is inserted into a contact surface between the upper bobbin and the lower bobbin.

The supporting member may be protruded from the other surface of the fixing body.

The transformer may further include a core combined with the plurality of bobbins to form a magnetic circuit, the supporting members being disposed on both sides of the core disposed on the bobbin fixing member.

According to another aspect of the present invention, there is provided a transformer, including: a bobbin part formed by stacking a plurality of bobbins; and a bobbin fixing member combined with at least two sequentially stacked bobbins to fix and combine at least two bobbins, wherein the bobbin fixing member includes at least one supporting member protruded outwardly.

BRIEF DESCRIPTION OF THE DRAWINGS

The above and other aspects, features and other advantages of the present invention will be more clearly understood from the following detailed description taken in conjunction with the accompanying drawings, in which.

DESCRIPTION OF EMBODIMENTS

Figure 1:
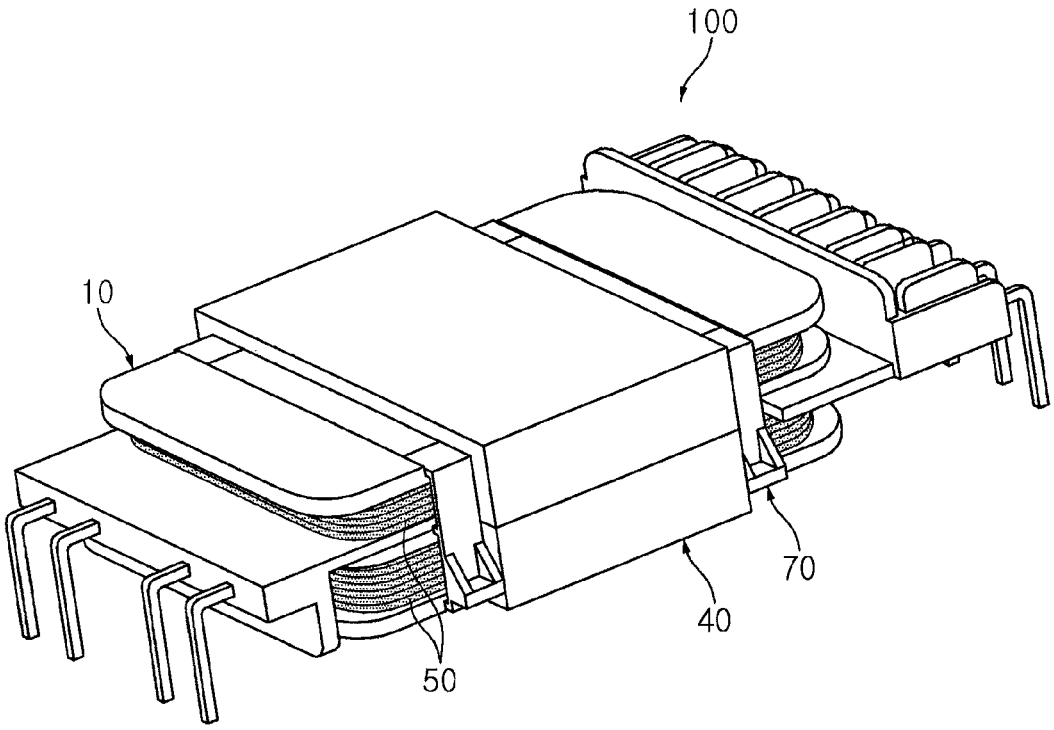
FIG. 1 is a perspective view schematically showing a transformer according to an embodiment of the present invention.

Before detailed description of the present invention, the terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention. Accordingly, it should be understood that embodiments described in the present specification and constitutions shown in the figures are only one of the best exemplary embodiments of the present invention, but do not represent all technical sprits of the present invention, and there may be various equivalents and modifications substituted therefor at the filing time of the present invention.

Hereinafter, the exemplary embodiments of the present invention will be described in detail with reference to the accompanying drawings. Herein, it should be noted that like reference numerals denote like constituent elements in the accompanying drawings. Further, the detailed description will be omitted with respect to the known functions and constitutions that may obscure the gist of the present invention. By the same reason, some constituent elements are magnified, omitted, or schematically drawn in the accompanying figures, and the sizes of respective constituent elements do not reflect real sizes completely.

Hereinafter, the exemplary embodiments of the present invention will be described in detail with reference to the accompanying drawings.

Figure 2:
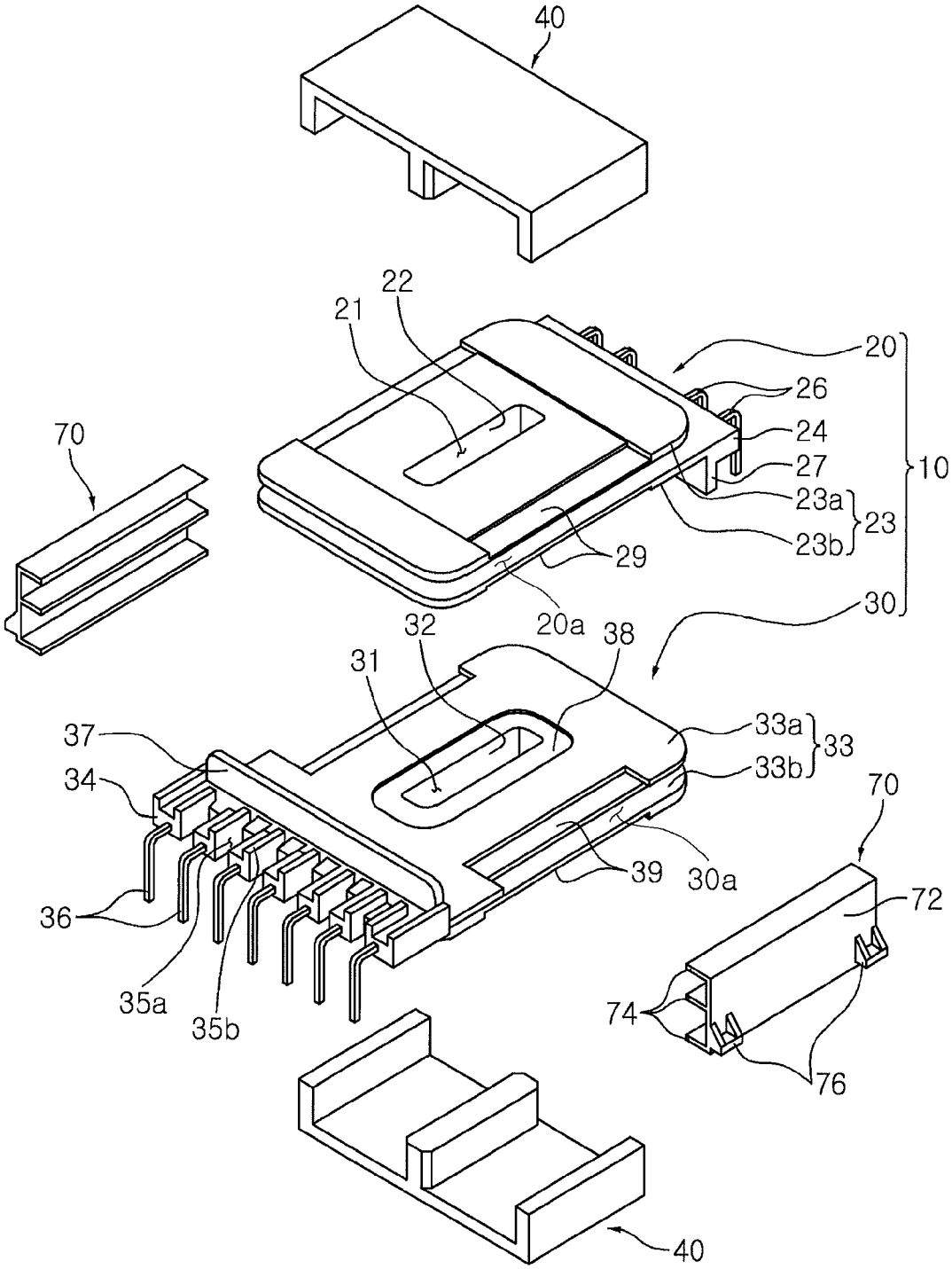
FIG. 2 is an exploded perspective view schematically showing the transformer shown in FIG. 1.

FIG. 1 is a perspective view schematically showing a transformer according to an embodiment of the present invention, and, FIG. 2 is an exploded perspective view schematically showing the transformer shown in FIG. 1.

Figure 3:
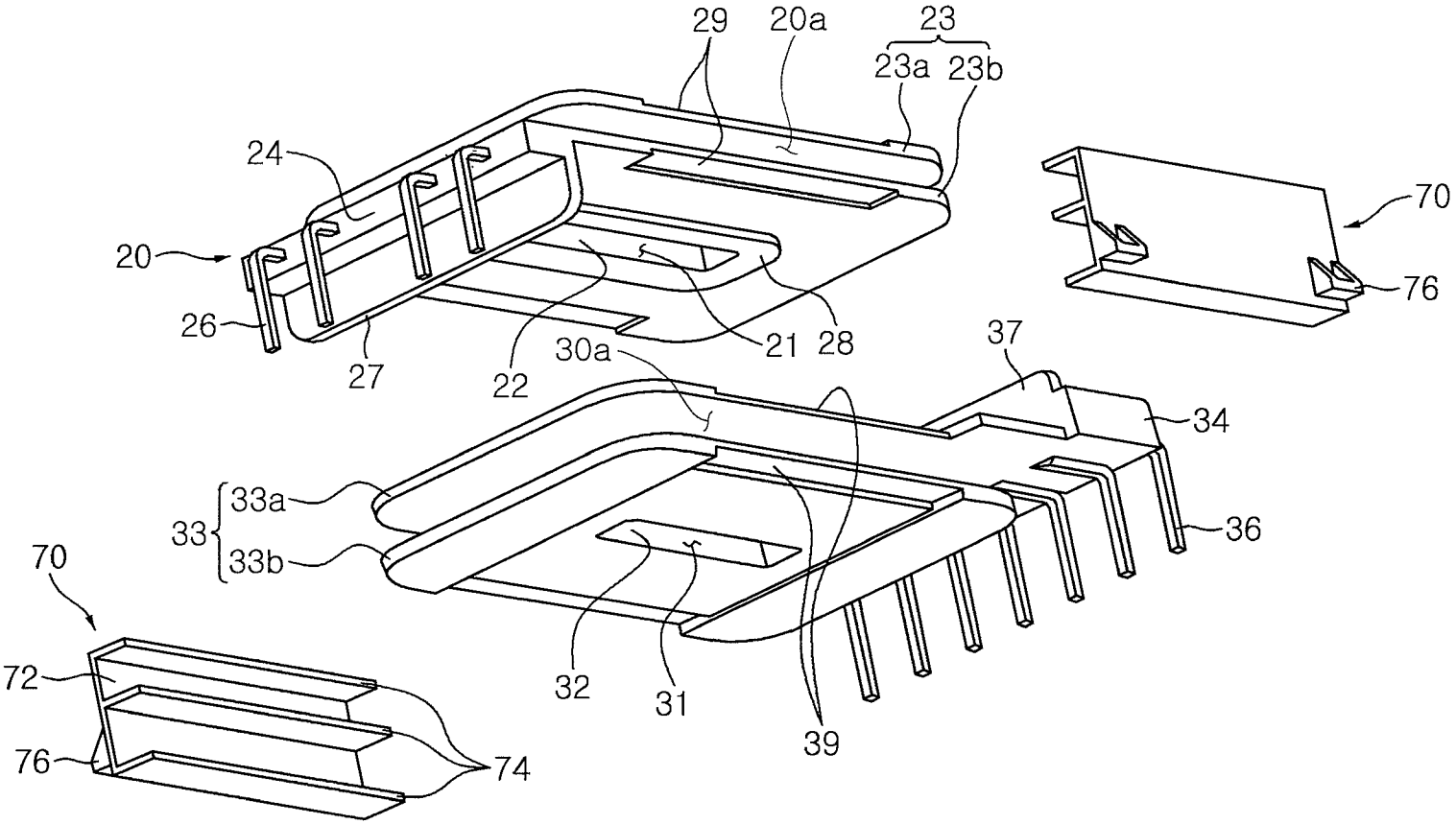
FIG. 3 and FIG. 4 are exploded views schematically showing a bobbin part of the transformer shown in FIG. 1.
Figure 4:
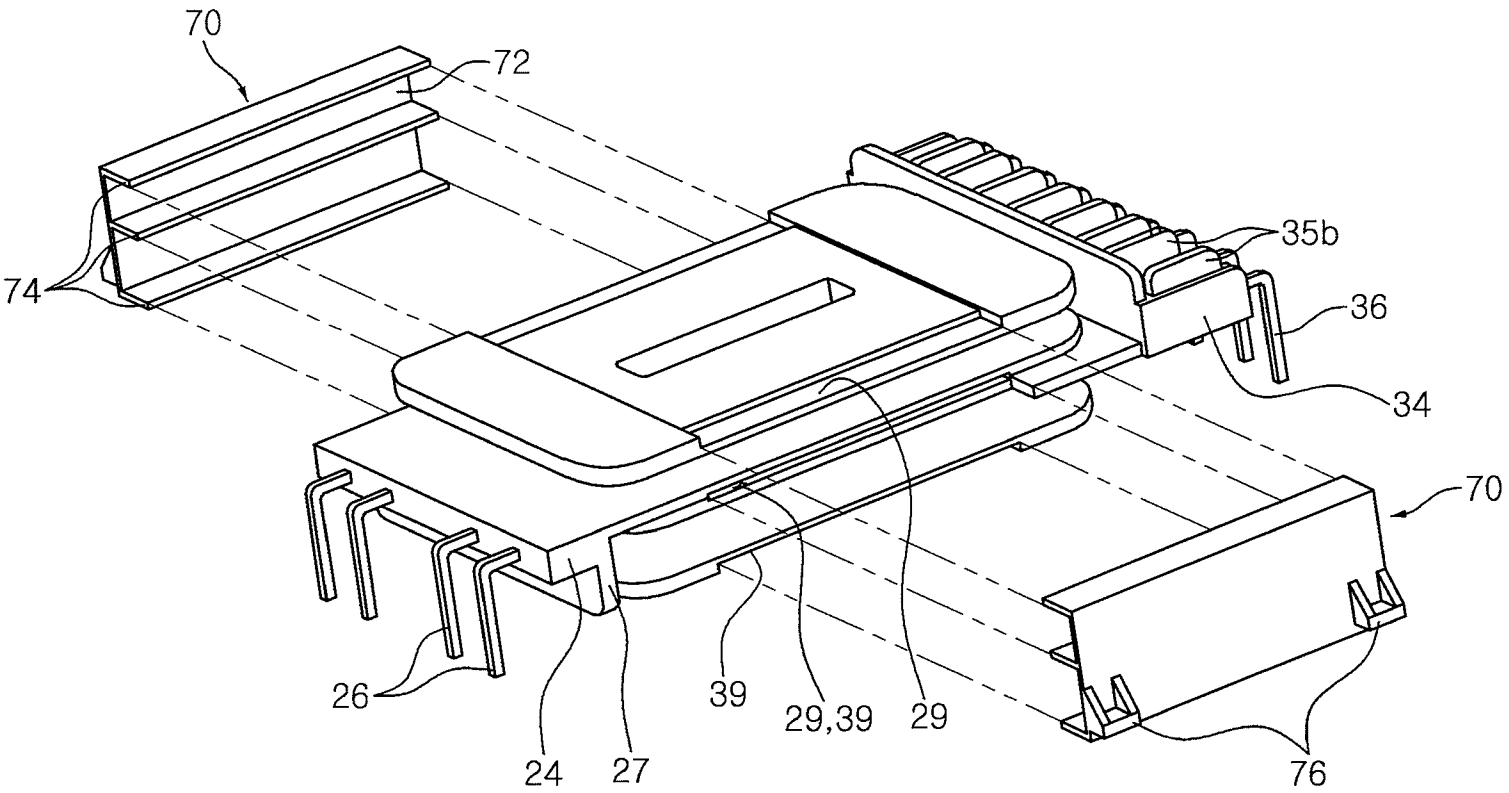
Figure 5:
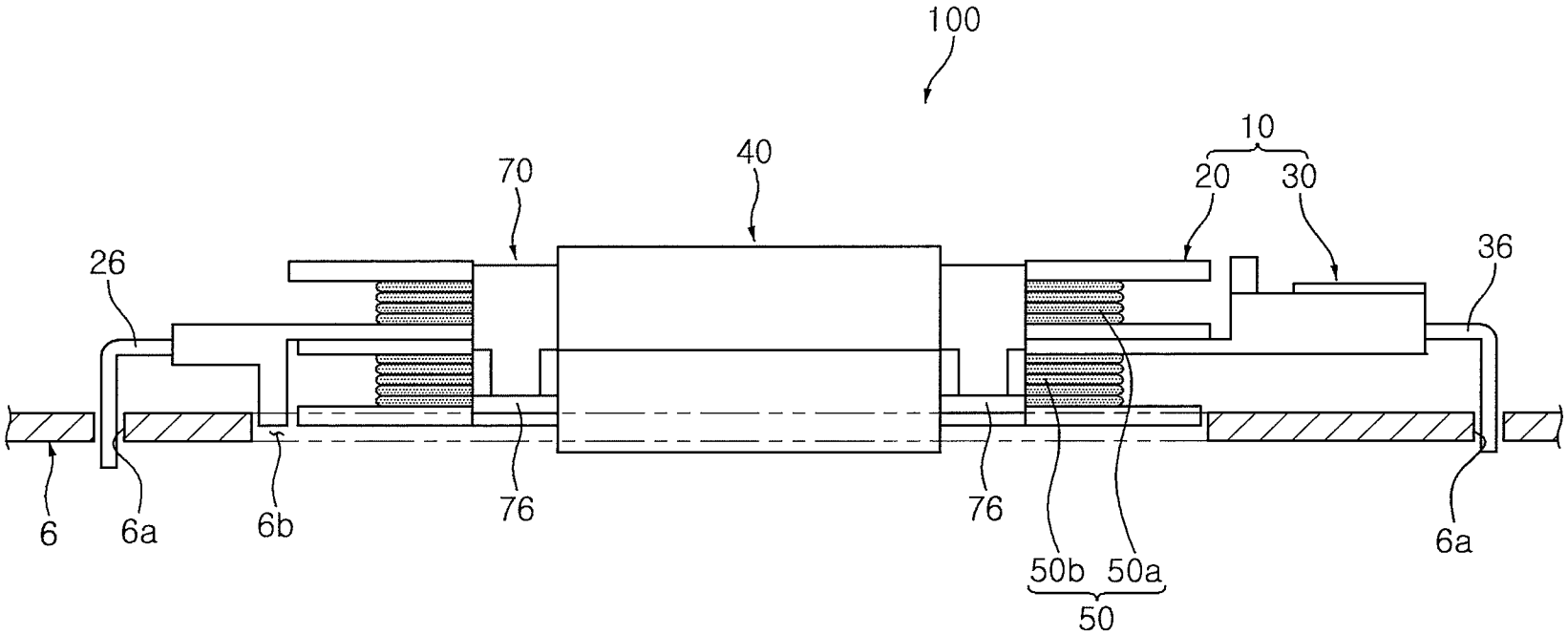
FIG. 5 is a side view of the transformer shown in FIG. 1.

In addition, FIG. 3 and FIG. 4 are exploded views schematically showing a bobbin part of the transformer shown in FIG. 1, and FIG. 5 is a side view of the transformer shown in FIG. 1.

Referring to FIG. 1 to FIG. 5, a transformer 100 according to an embodiment of the present invention may include a coil part 50, a core 40, a bobbin part 10, and bobbin fixing members 70.

The coil part 50 may include a primary coil 50*a* and a secondary coil 50*b*.

The primary coil 50*a* may be wound in a winding part 20*a* formed at an upper bobbin 20, which will be described below.

A plurality of coils 50 electrically insulated from one another within the winding part 20*a* may be wound to constitute the primary coil 50*a* according to the embodiment of the present invention. That is, in the transformer 100 according to the present embodiment, the primary coil 50*a* including the plurality of coils 50 may apply various voltages, and in response to this, the various voltages are capable of being withdrawn through the secondary coil 50*b*.

To achieve this, respective coils constituting the primary coil 50*a* may have different thicknesses, and the number of winding may be differently set. Further, one strand of wire may be used for the primary coil, and a Ritz Wire formed by twisting several strands of wires may be used.

The lead wires of the primary coil 50*a* are connected to external connection terminals 26 included in the upper bobbin 20.

The secondary coil 50*b* may be wound in a winding part 30*a* formed at a lower bobbin 30.

Like the primary coil 50*a* described above, a plurality of coils 50 electrically insulated from one another may be wound to constitute the secondary coil 50*b*. The lead wires of the secondary coil 50*b* are connected to external connection terminals 36 included in the lower bobbin 30.

The present embodiment takes an example of a case where the primary coil 50*a* may be wound in the winding part 20*a* of the upper bobbin 20 and the secondary coil 50*b* may be wound in the winding part 30*a* of the lower bobbin 30. However, the present invention is not limited thereto. When a user can obtain a desired voltage, there may be various applications, such as winding the primary coil 50*b* in the winding part 30*a* of the lower bobbin 30 and winding the secondary coil 50*a* in the winding part 20*a* of the upper bobbin 20.

The core 40 may be partially inserted in penetration holes 21 and 31 formed inside the upper bobbin 20 and the lower bobbin 30, respectively, to form a closed magnetic circuit. The core 40 according to the present embodiment may include a pair of cores, which may be inserted through the penetration hole 21 of the upper bobbin 20, to face each other, resulting in coupling thereof. 'EE' core, 'EI' core, and so on may be used for the core 40.

The core 40 may be formed of Mn—Zn base ferrite having high permeability, low loss, high saturation magnetic flux density, high stability, and low production costs as compared to other materials. However, according to the embodiment of the present invention, shapes or materials of the core 40 are not particularly limited.

The bobbin part 10 may include a lower bobbin 30 and at least one upper bobbin 20.

The upper bobbin 20, as shown in FIG. 2, may include a tube-shaped body part 22 having a penetration hole 21 in the center thereof, a flange part 23 vertically extended from either end of the body part 22 in a direction outward of an outward surface of the body part 22, external connection terminals 26 electrically and physically connected to the outside, and a terminal coupling part 24 with which the external connection terminals 26 are coupled.

The penetration hole 21 formed inside the body part 22 may be used as a passage into which a portion of the core 40 may be inserted. The present embodiment takes an example of a case where a cross section of the penetration hole 21 is formed in a rectangular shape. This constitution may be provided according to the shape of the core 40 inserted into the penetration hole 21. The upper bobbin 20 according to the embodiment of the present invention is not limited thereto, and the penetration hole 21 may be formed in various shapes correspondingly to the shape of the core 40 inserted thereinto.

The flange part 23 may be divided into an upper flange part 23*a* and a lower flange part 23*b* according to the forming position thereof. A space formed among an outer surface of the body part 22, the upper flange part 23*a*, and the lower flange part 23*b* may be used as the winding part 20*a* in which the coils 50 are wound. Thus, the flange part 23 may serve as supporting the coils 50 wounded around the winding part 20*a* at both sides thereof, at the same time while protecting the coils 50 from the outside and securing the insulation between the coils and the outside.

Meanwhile, an inner surface of the flange part 23 (i.e., a surface forming the winding part) may be formed in a sloping form. As a result, the thickness of the flange part 23 may be formed gradually thinner toward a direction outward of an outward surface of the flange part 23.

By this constitution, the bobbin part 10 may be easily separated from the molding in a manufacturing process of the bobbin part since the winding part 20*a* of the upper bobbin 20 (or the lower bobbin) may be formed more deeply than a bobbin of the transformer provided according to the related art.

In addition, a width of the flange part 23 may be larger than a thickness of the bobbin part 10 (i.e., body part) in the transformer 100 according to the present embodiment. This shape is provided in order to form the transformer 100 according to the present embodiment in a thin type, and the present invention is not limited thereto.

Meanwhile, in the flange part 23 according to the present embodiment, a portion that is not contacted with the core 40, i.e., a portion that is exposed to the outside, may be formed thicker than a portion which is positioned inside the core 40, at the combining time of the core 40. This may be equally applied to the lower bobbin 30, which will be described below. The flange parts 23 and 33 of the upper bobbin 20 and the lower bobbin 30 according to the present embodiment are capable of securing stiffness.

The terminal coupling part 24 may be formed on one side surface of the lower flange part 23*b* of the upper bobbin 20. The terminal coupling part 24 may be horizontally protruded in a form where the terminal coupling part may be extended to the outside from the lower flange part 23*b*. The terminal coupling part 24 may include external connection terminals 25 and a separating block 27.

The external connection terminals 26 are plural, and are coupled with the terminal coupling part 24 such that the external connection terminals 26 are protruded outwardly and downwardly from the terminal coupling part 24 in a direction outward of an outward surface of the body part 22.

The separating block 27 may be used to secure a creepage distance between the external connection terminals 26 and the lower bobbin 30. To achieve this, the separating block 27 may be protruded downwardly in parallel with an arrangement direction of the external connection terminals 26, between the lower bobbin 30 and the external connection terminals 26.

The coils 50 wounded around the lower bobbin 30, which will be described below, and the external connection terminals 26 of the upper bobbin 20 are separated from each other such that they do not directly face each other, by the separating block 27. As a result, the creepage distance may be secured.

In addition, the upper bobbin 20 according to the present embodiment may be combined with the lower bobbin 30 in a lamination type. To achieve this, the upper bobbin 20 may include a protruding part 28 which is protruded from a lower surface of the upper bobbin 20.

The protruding part 28 may be formed in the center of the lower surface of the upper bobbin 20, and protruded along the circumference of the penetration hole 21.

The protruding part 28 may be used to arrange the combining position between the upper bobbin 20 and the lower bobbin 30 easily when the upper bobbin 20 may be combined with the lower bobbin 30. This will be described in more detail in the description about the lower bobbin 30 below. Meanwhile, the protruding part 28 according to the present embodiment is not limited to the above constitution. That is, the protruding part may be formed at various positions, besides the neighborhood of the penetration hole 21. In addition, there may be various applications, such as forming the protruding part in a form of plural protrusions.

The lower bobbin 30 may be constituted in a shape similar to the upper bobbin 20, and formed in a thickness similar to that of the upper bobbin 20.

The lower bobbin 30, like the upper bobbin 20, may include a tube-shaped body part 32 having a penetration hole 31 in the center thereof, a flange part 33, a terminal coupling part 34, and external connection terminals 36. Therefore, the detailed description about the same constitution as the upper bobbin 20 is omitted, and constituent elements distinct from the upper bobbin 20 are described in more detail below.

The penetration hole 31 formed inside the body part 32 may be used as a passage into which a portion of the core 40 may be inserted, like the upper bobbin 20.

Also, a space formed between an outer surface of the body part 32 of the lower bobbin 30 and the flange part 33 may be used as the winding part 30*a* in which the coils 50 are wound.

As described above, in the lower bobbin 30 according to the present embodiment, when combined with the core 40, a portion exposed to the outside may be formed thicker than a portion positioned inside the core 40, in order to secure the stiffness of the flange part 33.

Similarly to the upper bobbin 20, the upper flange part 33*a* of the lower bobbin 30 may include a terminal coupling part 34. The terminal coupling part 34 may be provided with the external connection terminals 36 formed on one side surface of the upper flange part 33*a*.

The terminal coupling part 34 may be horizontally protruded from the upper flange part 33*a* in a direction outward of an outward surface of the body part 32. The terminal coupling part 34 may include guiding protrusions 35*b*, withdrawing grooves 35*a*, and a separating block 37.

A plurality of the guiding protrusions 35*b* are protruded upwardly from an upper surface of the terminal coupling part 34 in parallel with one another. The guiding protrusions 35*b* are for guiding the lead wires of the coils 50, which are wound in the winding part 30*a* of the lower bobbin 30, such that the lead wires is easily coupled with the external connection terminals 36. Accordingly, the guiding protrusions 35*b* may be protruded in a thickness corresponding to diameters of the lead wires of the coils 50 or more in order to guide the coils stably.

The withdrawing grooves 35*a* are formed between the guiding protrusions 35*b*, and used as a passage through which the lead wires of the coils 50, which are wound in the winding part 30*a*, move above the terminal coupling part 34.

By this constitution of the terminal coupling part 34, the lead wires of the coils 50 wound in the winding part 30*a* move above the lower bobbin 30 via the withdrawing grooves 35*a*, and then are electrically connected to the external connection terminals 36 through spaces between the guiding protrusions 35*b* disposed adjacently.

The separating block 37 may be protruded lengthily in a direction perpendicular to an arrangement direction of the guiding protrusions 35*b*, and disposed in a space between the guiding protrusions 35*b* and the upper bobbin 20 when the upper bobbin 20 and the lower bobbin are combined with each other. The coils 50 wounded around the upper bobbin 20 and the external connection terminals 26 of the lower bobbin 30 are separated from each other by the separating block 27 such that the coils 50 and the terminal 26 are not directly opposed to each other. As a result, the creepage distance is secured.

The external connection terminals 36 are coupled with the terminal coupling part 34 such that the external connection terminals 36 are protruded outwardly and downwardly from an end of the terminal coupling part 34 in a direction outward of an outward surface of the body part 32.

Further, the lower bobbin 30 according to the present embodiment may include a combining groove 38 formed on an upper surface thereof, in order to easily laminate and combine the lower bobbin 30 and the upper bobbin 20.

The combining groove 38 may be formed in the center of an upper surface of the lower bobbin 30, and formed in the form of groove along the circumstance of the penetration hole 31.

The protruding part 28 of the upper bobbin 20 may be inserted into and combined with the combining groove 38. As the protruding part 28 may be inserted into the combining groove 38, the combining position between the upper bobbin 20 and the lower bobbin 30 is easily arranged. Thus, the penetration holes 21 and 31 of the upper bobbin 20 and the lower bobbin 30 are arranged to constitute one hole.

Accordingly, the core 40 may be easily inserted into the arranged penetration holes 21 and 31 and combined with the bobbin part 10.

Meanwhile, the present embodiment takes an example of a case where the protruding part 28 may be formed on the upper bobbin 20 and the combining groove 38 may be formed on the lower bobbin 30, but the present invention is not limited thereto. There may be various applications, such as forming the combining groove on the upper bobbin 20 and forming the protruding part on the lower bobbin 30.

The bobbin part 10 according to the embodiment of the present invention is characterized by separating the external connection terminals 26 included in the upper bobbin 20 and the external connection terminals 36 included in the lower bobbin 30 from each other at the maximum distance. Accordingly, when the upper bobbin 20 may be combined with the lower bobbin 30, the upper bobbin 20 may be combined with the lower bobbin 30 such that a portion of the upper bobbin 20 where the terminal coupling part 24 is formed may be positioned in the opposite direction to, that is, not a portion where the terminal coupling part 34 of the lower bobbin 30 is formed.

The external connection terminals 36 of the lower bobbin 30 and the external connection terminals 26 of the upper bobbin 20 are arranged such that the terminals 36 and 26 are protruded in opposite directions to each other. Thus, the transformer 100 according to the present embodiment may fully separate between the external connection terminals 26 and 36, around which the primary coil 50*a* and the secondary coil 50*b* are wound, thereby easily securing an insulation distance between the primary coil 50*a* and the secondary coil 50*b*.

The individual bobbins 20 and 30 of the bobbin part 10 according to the present embodiment may be easily manufactured by injection molding, but not limited thereto, and may be manufactured by various ways such as press processing or the like. Further, the individual bobbins 20 and 30 of the bobbin part 10 according to the present embodiment may be formed of insulating type resin materials, and may be formed of materials having high heat-resistance and high voltage-resistance. Materials for forming the individual bobbins 20 and 30 may be Polyphenylene Sulfide (PPS), liquid crystal polymer (LCP), poly butylene terephthalate (PBT), polyethylene terephthalate (PET), phenolic resin, and the like.

The upper bobbin 20 and the lower bobbin 30 of the bobbin part 10 according to the present embodiment constituted above are combined with each other by separate bobbin fixing members 70. To achieve this, the upper bobbin 20 and the lower bobbin 30 have insertion grooves 29 and 39, respectively.

The insertion grooves 29 and 39 may be partially formed on outer surfaces of the upper and lower flange parts 23 and 33 along the outer surface thereof, respectively. More specifically, the insertion grooves 29 and 39 are formed on the outer surfaces of the upper and lower flange parts 23 and 33 of the individual bobbins 20 and 30, respectively. The insertion grooves 29 and 39 respectively have one surface opened along corresponding respective side surfaces.

Accordingly, when the upper bobbin 20 and the lower bobbin 30 are laminated and combined, the insertion grooves 29 and 39, which are formed at both sides of the individual bobbins 20 and 30 respectively, are disposed in a vertically arranged form.

The bobbin fixing members are inserted into these insertion grooves 29 and 39.

The bobbin fixing members 70 are combined with both side surfaces of the upper bobbin 20 and the lower bobbin 30 through insertion, to fix the upper bobbin 20 and the lower bobbin 30 so that the upper bobbin 20 and the lower bobbin 30 are not separated from each other.

The bobbin fixing member 70 may include a plate-shaped fixing body 72, and a plurality of insertion plates 74 protruded from one surface of the fixing body 72 and separated from each other.

In the present embodiment, the bobbin fixing member 70 has three insertion plates 74. Thus, the bobbin fixing member 70 has a cross section of 'E' shape.

The bobbin fixing members 70 are combined with both side surfaces of the bobbin part 10 by inserting the insertion plates 74 into the insertion grooves 29 and 39 mentioned above. Herein, three insertion plates 74 are inserted into the insertion grooves 29 and 39 formed on the upper surface of the upper bobbin 20, the lower surface of the lower bobbin 30, and a contact surface between the upper bobbin 20 and the lower bobbin 30, respectively.

As such, the upper bobbin 20 and the lower bobbin 30 are fixed to each other by the bobbin fixing members 70, to be constituted in one body. Thus, the upper bobbin 20 combined with the lower bobbin 30 is not easily separated from the lower bobbin 30.

Herein, since the insertion grooves 29 and 39 formed on the contact surface between the upper bobbin 20 and the lower bobbin 30 meet each other to form one groove, the width thereof may be larger than widths of the other insertion grooves 29 and 39. Accordingly, in the bobbin fixing member 70, the insertion plate 74 positioned in the middle thereof between the insertion plates (hereafter, referred to as 'middle insertion plate') may be formed in a thickness corresponding to the above width.

However, the present invention is not limited thereto, and there may be various applications, such as forming the insertion groove 29 or 39 on only one of the upper bobbin 20 and the lower bobbin 30 in the contact surface between the upper bobbin 20 and the lower bobbin 30, and forming the middle insertion plate 74 of the bobbin fixing member 70 correspondingly to a corresponding insertion grooves 29 or 39.

As such, the transformer 100 according to the present embodiment is capable of combining and fixing the upper bobbin 20 and the lower bobbin 30 very easily by using the bobbin fixing members 70.

Further, the transformer 100 according to the present embodiment is capable of securing the creepage distance between the primary coil 50*a* wound around the upper bobbin 20 and the secondary coil wound around the lower bobbin 30 by respectively inserting the bobbin fixing members 70 into both sides of the upper bobbin 20 and the lower bobbin. Accordingly, the insulating reliability between the primary coil 50*a* and the secondary coil 50*b* may be secured in the side surfaces of the bobbin part 10.

Further, the bobbin fixing members 70 according to the present embodiment may be disposed between the core 40 to be described below and the bobbin part 10, thereby securing the insulation between the coils 50 wound around the bobbin part and the core 40.

Meanwhile, although the present embodiment takes an example of the bobbin fixing members 70 each having three insertion plates 74, the present invention is not limited thereto. For example, the bobbin fixing member may be formed to have only two insertion plates such that the cross section of each of the bobbin fixing members has a '⊂' shape by removing the middle insertion plate 74. In this case, the bobbin fixing members support the upper surface of the upper bobbin 20 and the lower surface of the lower bobbin 30, and fixes and combines the upper bobbin 20 and the lower bobbin 30.

The transformer 10 according to the present embodiment constituted as the above is capable of securing larger leakage inductance as compared to the transformer provided according to the related art by winding the coils 50*a* and 50*b* around the plurality of bobbins 20 and 30 individually separated, respectively. While the prior transformer secures the leakage inductance of 1 to 15 μH, the transformer 100 according to the present embodiment is capable of securing the leakage inductance of 10 to 50 μH. Accordingly, additive external inductors are not required for securing the leakage inductance, thereby reducing the manufacturing costs.

The transformer 100 according to the present embodiment may be safely seated on a substrate like the prior transformer. As well, the transformer 100 according to the present embodiment may be mounted on the substrate such that the transformer is contained inside the substrate.

To achieve this, the bobbin fixing member 70 according to the present embodiment may include support protrusions 76 protruded from the other surface of the fixing body 72.

The number of the support protrusions 76 may be at least two. The support protrusions may be arranged in a line parallel with a plane which is formed by the flange parts 23 and 33 of the bobbin part 10, and separated from each other by a distance wider than a width of the core 40.

A case where the transformer 100 is mounted on a substrate by using the support protrusions 76 is shown in FIG. 5.

Referring to FIG. 5, the transformer 100 according to the present embodiment may be mounted on a substrate 6 in which coupling holes 6*a* and a penetration hole type receiving part 6*b* are formed.

Herein, the external connection terminals 26 and 36 of the transformer 100 are inserted into the coupling holes 6*a* formed in the substrate 6, and safely seated on the substrate 6. In addition, the transformer 100 may be mounted on the substrate 6 such that the transformer 100 is received inside the receiving part 6*b*.

In the transformer 100 according to the present embodiment, lower surfaces of the support protrusions of the bobbin fixing member 70 are hung on an upper surface of the substrate 6 to support the entire of the transformer 100. As such, the support protrusions 76 are safely seated on the substrate 6 to fix and safely seat the transformer 100 on the substrate 6, thereby preventing the transformer 100 from moving below the substrate 6.

As such, the transformer 100 according to the present embodiment may be safely seated on the substrate 6 by using the support protrusions 76. Accordingly, the mounting height of the transformer 100 may be set by controlling the position at which the support protrusions 76 are protruded from the bobbin fixing member 70. In other words, the mounting height of the transformer 100 is capable of being easily controlled by forming the support protrusions 76 at a specific position when manufacturing the bobbin fixing member 70.

As such, when the penetration holes 6*b* are formed in the substrate 6 and the transformer 100 may be mounted on the substrate 6 such that the transformer 100 is inserted into the receiving part 6*b*, the entire mounting height of the substrate 6 on which the transformer is mounted may be reduced. Accordingly, the entire thickness of an electronic device (e.g., a display device) in which the substrate 6 is mounted may be substantially reduced.

Figure 6:
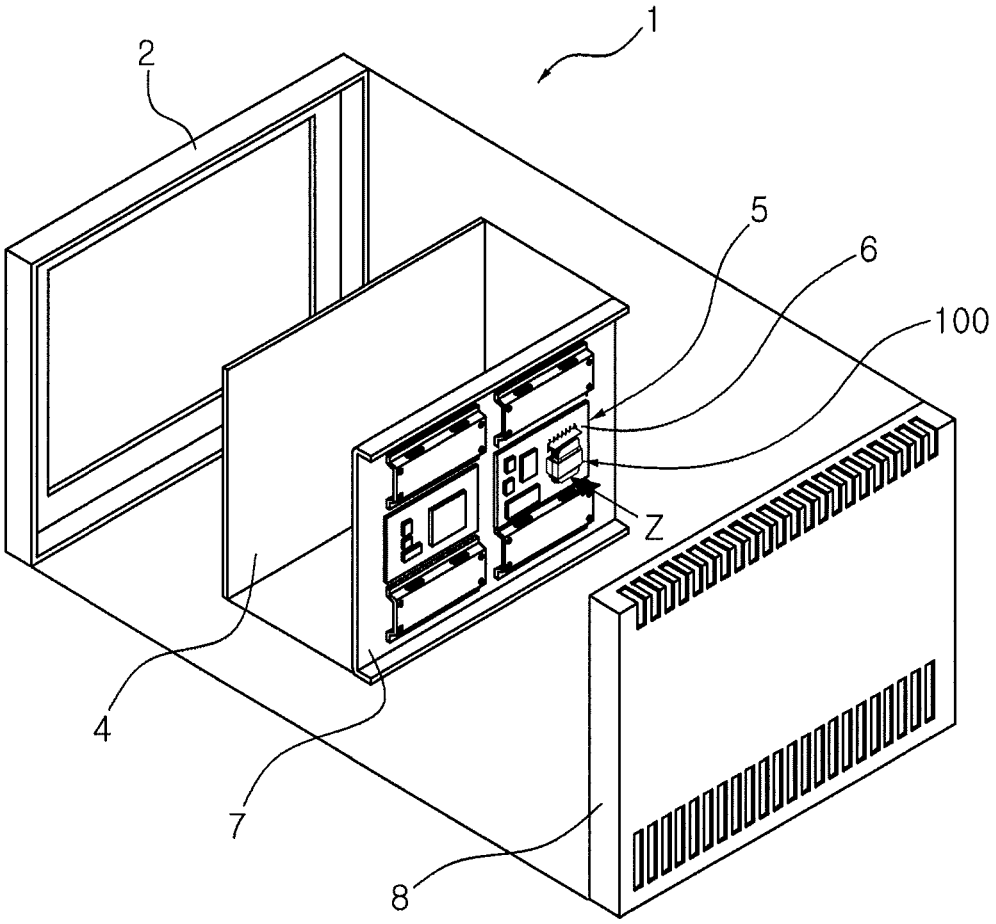
FIG. 6 is an exploded view schematically showing a flat panel display device according to an embodiment of the present invention.

FIG. 6 is an exploded perspective view schematically showing a flat panel display device according to an embodiment of the present invention.

Referring to FIG. 6, a flat panel display device 1 according to an embodiment of the present invention may include a display panel 4, a power supply unit 5 on which transformer 100 is mounted, and covers 2 and 8.

The covers 2 and 8 include a front cover 2 and a back cover 8, which may be combined with each other to form an inner space.

The display panel 4 may be disposed in the inner space formed by the covers 2 and 8, and as the display panel 4, various flat panel display panels such as a liquid crystal display (LCD), a plasma display panel (PDP), an organic light emitting diode (OLED), and so on, may be used.

The power supply unit 5 (e.g., SMPS) supplies power to the display panel 4. A plurality of electronic parts may be mounted on a substrate 6 (e.g., PCB) in the power supply unit 5, and particularly, at least one transformer according to the above-described embodiment may be mounted.

The power supply unit 5 may be fixed to a chassis 7, and may be disposed and fixed in the inner space formed by the covers 2 and 8 together with the display panel 4.

Herein, the coils 50 (FIG. 5), may be wound to be parallel to the substrate 6 in the transformer 100 mounted on the power supply unit. Also, when shown from a plane of the substrate 6 (Z direction), the coils 50 are wound clockwise or counterclockwise.

As such, when the coils 50 are wound in parallel with the substrate 6, the degree to which the magnetic flux generated in the transformer 100 interferes with the outside (e.g., a cover, etc.) may be reduced.

Accordingly, although the transformer 100 is installed in a thin electronic device such as a flat panel display device, the degree to which the magnetic flux generated in the transformer 100 interferes with the back cover 8 of the flat panel display device 1 may be reduced.

That is, the flat panel display device 1 according to the present embodiment is capable of preventing the generation of noise due to interference generated between the transformer 100 and the back cover 8.

The transformer according to the embodiment of the present invention may include a plurality of bobbins individually separated from each other (e.g., an upper bobbin and a lower bobbin), and has a structure where these bobbins are combined by a separate bobbin fixing member. As a result, the upper bobbin and the lower bobbin are easily combined at the manufacturing time of the transformer. The upper bobbin and the lower bobbin after combination may be stably fixed. Accordingly, the upper bobbin and the lower bobbin are not separated easily, or the combined state therebetween is not deformed.

In addition, the transformer according to the embodiment of the present invention may include individual bobbins allowing separation and assembly thereof. Accordingly, the transformer is manufactured by winding the coils around the individual bobbins simultaneously and then combining the individual bobbins. Thus, the costs and times required for manufacturing may be substantially reduced.

Further, the transformer according to the embodiment of the present invention may secure an insulation distance between primary coil and a secondary coil by using a bobbin fixing member. As a result, the insulating reliability of the transformer may be secured.

Further, the transformer according to the embodiment of the present invention may secure a leakage inductance relatively larger than that of the transformer according to the related art by winding coils around plural bobbins individually separated. As a result, additive external inductors do not need to be added, thereby reducing the manufacturing costs.

Further, the transformer according to the embodiment of the present invention may be mounted on a substrate in a desired mounting height by using support protrusions formed on the bobbin fixing member. Accordingly, the entire mounting height of the substrate may be reduced.

Further, when the transformer according to the embodiment of the present invention may be mounted on the substrate, a state where the coils of the transformer are wound in parallel with the substrate is maintained. As such, when the coils are wound in parallel with the substrate, the degree to which the magnetic flux generated in the transformer interferes with the outside may be reduced.

Accordingly, although the transformer is installed in a thin display device, the degree to which interference is generated in the back cover of the display device may be reduced by the magnetic flux generated in the transformer, thereby preventing noise from being generated by the transformer in the display device. This constitution may be easily employed in the thin display device.

Meanwhile, the transformer and the flat panel display device including the same according to the embodiment of the present invention are not limited to the above-described embodiments, and various applications may be applied. For example, in the transformer according to the embodiment of the present invention, the bobbin fixing member may be applied in various shapes when the combining force between the upper bobbin and the lower bobbin is secured.

Further, the above-described embodiment takes an example of a case where the bobbins are formed in a rectangular shape, the edges of which have curved surface. However, the present invention is not limited thereto, and the bobbins may be formed in various shapes such as circles or ellipses when a desired voltage is obtained.

Further, the above-described embodiment takes an example of a case where the bobbin part may include the lower bobbin and the upper bobbin, but the present invention is not limited thereto. That is, more individual bobbins may be laminated on the upper bobbin or interposed between the upper bobbin and the lower bobbin and then combined with each other, when necessary.

In addition, the present embodiment illustrates a transformer employed in a display device as an example. However, the present invention is not limited thereto, and is widely applicable to any of electronic devices having transformers.

While the present invention has been shown and described in connection with the exemplary embodiments, it will be apparent to those skilled in the art that modifications and variations can be made without departing from the spirit and scope of the invention as defined by the appended claims.

What is claimed is:

1. A transformer, comprising:

a bobbin part including a lower bobbin and an upper bobbin vertically laminated above the lower bobbin and combined with the lower bobbin, each bobbin including a tube-shaped body part having a penetration hole therein, and flange parts protruded outwardly from both sides of the body part, and a terminal coupling part protruded from one side of the flange part of each of the bobbins, and the terminal coupling part of the lower bobbin is protruded from an upper flange part, while the terminal coupling part of the upper bobbin is protruded from a lower flange part, each terminal coupling part having external connection terminals protruding therefrom; and a coil part including coils respectively wound around the upper bobbins and lower bobbin, wherein at least one bobbin includes withdrawing grooves formed in a space between the external connection terminals, the coils wound around the at least one bobbin being withdrawn outwardly of the at least one bobbin via the withdrawing grooves and coupled to the external connection terminals, the lower and upper bobbins are combined with each other such that the terminal coupling part of the lower bobbin and the terminal coupling part of the upper bobbin are arranged in opposite directions, the terminal coupling part of the upper bobbin includes a separating block protruded downwardly between the coils wound around the lower bobbin and the external connection terminals of the upper bobbin to secure an insulation distance therebetween, and the terminal coupling part of the lower bobbin includes a separating block protruded upwardly between the coils wound around the upper bobbin and the external connection terminals of the lower bobbin to secure an insulation distance therebetween.

2. The transformer of claim 1, wherein at least one bobbin among the lower bobbin and the upper bobbin includes a plurality of guiding protrusions formed on the terminal coupling part, the coils being coupled to the external connection terminals via the space between the guiding protrusions.

3. The transformer of claim 2, wherein the withdrawing grooves are formed between the guiding protrusions.

4. The transformer of claim 1, further comprising a bobbin fixing member combined with the bobbin part to fix and combine at least two of the bobbins.

5. The transformer of claim 4, wherein the bobbin fixing member includes at least one supporting member protruded outwardly.

6. The transformer of claim 4, wherein the bobbin fixing member further includes at least one supporting member being safely seated on a substrate so as to support the transformer when the transformer is being mounted on the substrate.

7. A transformer, comprising:

a bobbin part including a lower bobbin and an upper bobbin vertically laminated above the lower bobbin and combined with the lower bobbin, each bobbin including a tube-shaped body part having a penetration hole therein, and flange parts protruded outwardly from both sides of the body part, and a terminal coupling part protruded from one side of the flange part of each of the bobbins, and the terminal coupling part of the lower bobbin is protruded from an upper flange part, while the terminal coupling part of the upper bobbin is protruded from a lower flange part, each terminal coupling part having external connection terminals protruding therefrom; and a coil part including coils respectively wound around the upper bobbins and lower bobbin, wherein at least one bobbin among the upper bobbin and the lower bobbin includes a plurality of guiding protrusions formed on the terminal coupling part, the coils wound around at least one of the bobbins supporting the guiding protrusions and being coupled to the external connection terminals, the lower and upper bobbins are combined with each other such that the terminal coupling part of the lower bobbin and the terminal coupling part of the upper bobbin are arranged in opposite directions, the terminal coupling part of the upper bobbin includes a separating block protruded downwardly between the coils wound around the lower bobbin and the external connection terminals of the upper bobbin to secure an insulation distance therebetween, and the terminal coupling part of the lower bobbin includes a separating block protruded upwardly between the coils wound around the upper bobbin and the external connection terminals of the lower bobbin to secure an insulation distance therebetween.

8. A transformer, comprising:

a bobbin part including a lower bobbin and an upper bobbin vertically laminated above the lower bobbin and combined with the lower bobbin; and a core having a center leg and two side legs combined with the plurality of bobbins to form a magnetic circuit;

at least one bobbin fixing member combined with the bobbin part in which the upper bobbin and the lower bobbin are laminated to fix and combine the upper bobbin and the lower bobbin, wherein the bobbin fixing member includes at least two supporting members being safely seated on a substrate to support the transformer when the transformer is mounted on the substrate, at least one bobbin fixing member includes a plate-shaped fixing body, the supporting members are protruded from an outer surface of the bobbin fixing body, the supporting members are separated from each other by a distance wider than a width of the side leg, and at least one side leg is disposed between the supporting members.

9. The transformer of claim 8, wherein at least one bobbin fixing member includes:

at least two intersection plates protruded from an inner surface of the fixing body to support the upper surface of the upper bobbin and the lower surface of the lower bobbin.

10. The transformer of claim 9, wherein the bobbin fixing member further includes a middle insertion plate formed in the middle of the fixing body so that the middle insertion plate is inserted into a contact surface between the upper bobbin and the lower bobbin.

11. The transformer of claim 9, wherein the supporting members being disposed on both sides of the core are disposed on the bobbin fixing member.

* * * * *